US006486616B1

(12) United States Patent
Liu et al.

(10) Patent No.: US 6,486,616 B1
(45) Date of Patent: Nov. 26, 2002

(54) DUAL CONTROL DIMMING BALLAST

(75) Inventors: Guang Liu, Lake Zurich; Sameer Sodhi, Palatine, both of IL (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 09/513,697

(22) Filed: Feb. 25, 2000

(51) Int. Cl.[7] ..... G05F 1/00
(52) U.S. Cl. ..... 315/291; 315/209 R; 315/DIG. 4
(58) Field of Search ..... 315/209 R, 224, 315/225, 244, 247, 291, 307, DIG. 4, 194, 219, DIG. 7; 363/39–41, 89, 98, 124

(56) References Cited

U.S. PATENT DOCUMENTS 5,107,184 A 4/1992 Hu et al. ..... 315/291
5,237,244 A * 8/1993 Bertenshaw et al. ..... 315/291
5,239,240 A * 8/1993 Omori ..... 315/291
5,264,823 A 11/1993 Stevens ..... 340/310 A
5,455,490 A 10/1995 Callahan et al. ..... 315/194
5,457,360 A 10/1995 Notohamiprodjo et al. . 315/219
5,539,281 A 7/1996 Shackle et al. ..... 315/224
5,872,429 A 2/1999 Xia et al. ..... 315/194
6,008,590 A * 12/1999 Giannopoulos et al. ..... 315/291
6,144,169 A * 11/2000 Janczak ..... 315/224
6,229,271 B1 * 5/2001 Liu ..... 315/225

* cited by examiner

*Primary Examiner*—Don Wong
*Assistant Examiner*—Wilson Lee
(74) *Attorney, Agent, or Firm*—Kenneth D. Labudda

(57) ABSTRACT

A dimming ballast apparatus comprises at least one power line dimming control input and at least one non-power-line dimming control input. In a preferred embodiment, the apparatus comprises a firing-angle-to-pulse-width-modulation converter responsive to the power line dimming control input, a voltage-to-pulse-width-modulation converter responsive to the non-power-line dimming control input, a low-pass filter responsive to the firing-angle-to-pulse-width-modulation converter and the voltage-to-pulse-width-modulation converter, and a dimming ballast circuit having a dim level command input responsive to the low-pass filter.

8 Claims, 5 Drawing Sheets

DUAL CONTROL DIMMING BALLAST

TECHNICAL FIELD

The present invention relates to dimmable ballast systems.

BACKGROUND OF THE INVENTION

In existing ballast circuits for powering fluorescent lamps at an adjustable illumination level, a number of different methods are used for dimming control. One popular method for dimming control employs a phase-control device, such as a triac. The phase-control device is used to modify a firing phase angle of an alternating current (AC) powering signal. A dimming ballast circuit, in turn, controllably dims a fluorescent lamp based on the firing phase angle.

Another popular method for dimming control is based on a direct current (DC) input, such as a 0 to 10 Volt DC input, distinct from an AC powering signal. In this method, an inverter circuit controllably dims a fluorescent lamp based on the magnitude of the DC input.

BRIEF DESCRIPTION OF THE DRAWINGS

The invention is pointed out with particularity in the appended claims. However, other features of the invention will become more apparent and the invention will be best understood by referring to the following detailed description in conjunction with the accompanying drawings in which:

DETAILED DESCRIPTION OF PREFERRED EMBODIMENTS

Embodiments of the present invention provide a dual control dimming ballast apparatus. Embodiments of the dual control dimming ballast apparatus are capable of accepting and providing two dimming controls: a power-line-based dimming control and a non-power-line-based dimming control. Preferably, the power-line-based dimming control is responsive to a firing angle of a phase-cut AC powering signal generated by a triac. Preferably, the non-power-line-based dimming control is responsive to a DC control signal. Embodiments of the present invention beneficially provide a ballast which is compatible with multiple dimming control methods, and that may be used for multiple lamp applications.

As used in this patent application, the term "lamp" is inclusive of discharge lamps in general. This includes not only fluorescent lamps, but other other types of discharge lamps, such as high-intensity discharge (HID) lamps, as well.

Figure 1:
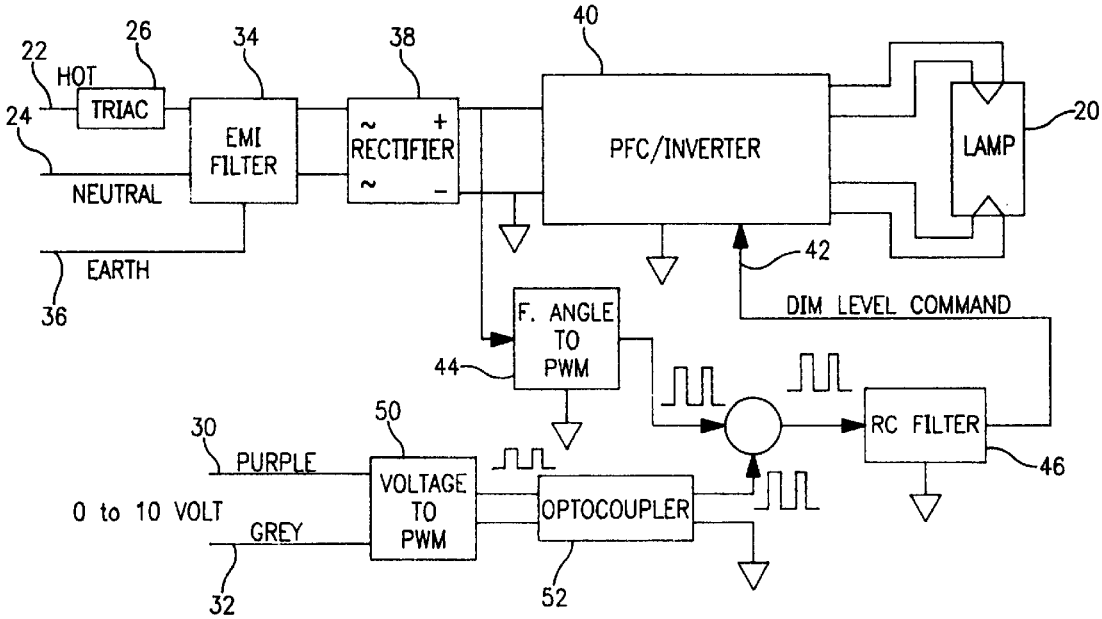
FIG. 1 is a block diagram of an embodiment of a dual control dimming ballast apparatus.

FIG. 1 is a block diagram of an embodiment of a dual control dimming ballast apparatus for controlling a lamp 20. The apparatus receives mains power from AC power lines 22 and 24. The AC power lines 22 and 24 may be referred to as either "HOT" and "NEUTRAL" respectively, or "SUPPLY" and "COMMON" respectively.

A phase-cut triac 26 may be coupled to the AC power line 22 to provide a power-line-type control for dimming the lamp 20. The phase-cut triac 26 varies a firing angle of a phase-cut powering signal to encode a dimming-control signal therein. The dual control dimming ballast apparatus is capable of dimming the lamp 20 based on the firing angle.

A non-power-line dimming control signal is receivable via inputs 30 and 32. Preferably, the non-power-line dimming control signal comprises a DC voltage applied across the inputs 30 and 32. The DC voltage is variable within a range such as 0 VDC to 10 VDC. Preferably, the DC voltage has an amplitude less than that of the AC powering signal. The dual control dimming ballast apparatus is further capable of dimming the lamp 20 based on the DC voltage.

An EMI (electromagnetic interference) filter 34 is coupled to an output of the triac 26, the AC power line 24 and an earth ground line 36. The EMI filter 34 provides an AC signal to a rectifier 38 coupled thereto. The rectifier 38 rectifies the AC signal for application to a power factor correction (PFC)/inverter circuit 40 coupled thereto. The PFC/inverter circuit 40 is for controlling and powering the lamp 20 based upon power received from the rectifier 38 and a dim level command signal received from a dim level input 42.

A firing-angle-to-PWM (pulse width modulation) converter 44 is coupled to the output of the rectifier 38. The firing-angle-to-PWM converter 44 generates a pulsed signal whose pulse width is modulated based on the firing angle of the output of the rectifier 38.

A filter 46, such as a low pass filter, is responsive to the firing-angle-to-PWM converter 44. The filter 46 produces a signal having a DC voltage level related to the pulse width from the firing-angle-to-PWM converter 44. The signal from the filter 46 is applied to the dim level input 42 to provide a dim level command signal. The PFC/inverter circuit 40 dims the lamp 20 based on the dim level command signal at dim level input 42. Therefore, the firing-angle-to-PWM converter 44, the filter 46 and the PFC/inverter circuit 40 cooperate to dim the lamp 20 based on the firing angle produced by the phase-cut triac 26.

A voltage-to-PWM converter 50 is responsive to the inputs 30 and 32. The voltage-to-PWM converter 50 generates a pulsed signal whose pulse width is modulated based on the voltage between the inputs 30 and 32.

An optocoupler 52 couples the voltage-to-PWM converter 50 to the filter 46. The optocoupler 52 optically isolates the voltage-to-PWM converter 50 and the inputs 30 and 32 from the firing-angle-to-PWM filter 44.

The filter 46 produces a signal having a DC voltage level related to the pulse width from the voltage-to-PWM converter 50. The signal from the filter 46 is applied to the dim level input 42 to provide a dim level command signal. The PFC/inverter circuit 40 dims the lamp 20 based on the dim level command signal. Therefore, the voltage-to-PWM converter 50, the optocoupler 52, the filter 46 and the PFC/inverter circuit 40 cooperate to dim the lamp 20 based on the voltage between the inputs 30 and 32.

Figure 2:
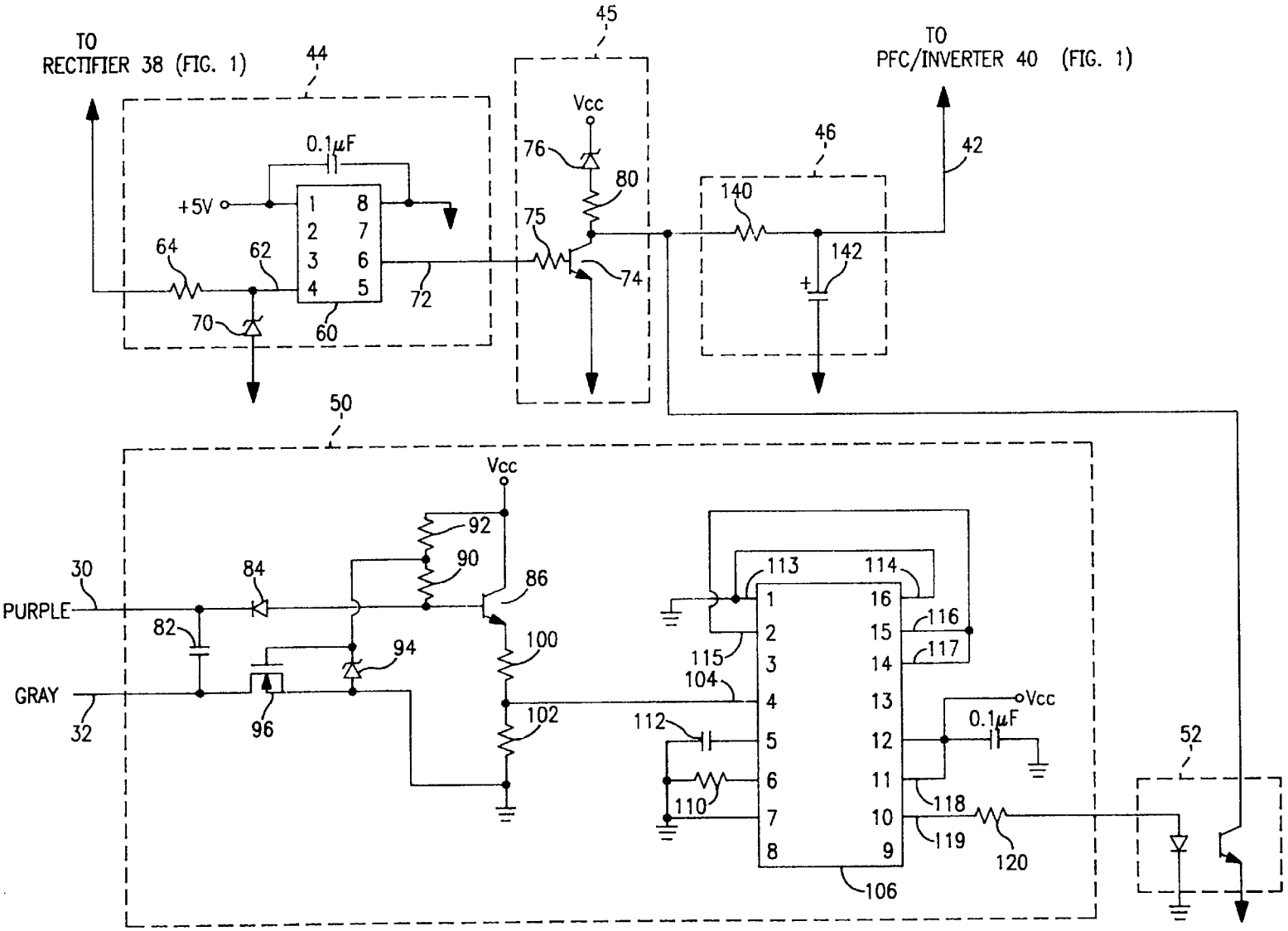
FIG. 2 is a schematic diagram of a preferred implementation of the voltage-to-PWM converter, the firing-angle-to-PWM converter, the optocoupler, and the filter in the arrangement of FIG. 1.

FIG. 2 is a schematic diagram of an implementation of the dual control dimming ballast apparatus of FIG. 1. The firing-angle-to-PWM converter 44 comprises a microcontroller 60. The microcontroller 60 has an input 62 coupled to the rectifier 38 of FIG. 1 by way of resistor 64. A zener diode 70 is coupled between the input 62 and ballast ground. The microcontroller 60 is programmed to convert a firing angle received at the input 62 to a pulse width modulated signal provided at an output 72.

Circuit 45 accepts the output 72 from the firing-angle-to-PWM converter 44. Circuit 45 comprises a transistor 74, a resistor 75, a zener diode 76, and a resistor 80. The output 72 from the firing-angle-to-PWM converter 44 is coupled to a base of transistor 74 by way of resistor 75. The transistor 74 has an emitter coupled to ballast ground, and a collector coupled to a supply line VCC by a series combination of zener diode 76 and resistor 80. The collector of transistor 74 is coupled to an input of the filter 46.

The voltage-to-PWM converter 50 comprises a capacitor 82 coupled between input 30 and input 32. A diode 84 has a cathode coupled to the input 30 and an anode coupled to a base of a transistor 86. The transistor 86 has a collector coupled to the supply line VCC, and a base coupled to the supply line VCC by a series combination of resistors 90 and 92. A zener diode 94 is coupled between control ground and the junction of the resistors 90 and 92; as used herein, "control ground" should be understood to be distinct and separate from "ballast ground", as the two grounds are actually at very different potentials with respect to earth ground. A transistor 96 has a gate coupled to the junction of resistors 90 and 92, a drain coupled to input 32, and a source coupled to control ground. The transistor 86 has an emitter coupled to control ground through a series combination of resistors 100 and 102.

The junction of the resistors 100 and 102 is coupled to a dead-time control (DTC) input 104 of a PWM control circuit 106, such as one having part number TL494. The aforementioned components in the voltage-to-PWM converter 50 act to divide the voltage between the inputs 30 and 32, based on the values of the resistors 100 and 102, for application to the DTC input 104. The aforementioned components further act to limit the maximum and minimum voltages which are applied to the DTC input 104.

The PWM control circuit 106 has an on-chip oscillator controlled by a timing resistor 110 and a timing capacitor 112. The PWM control circuit 106 also has on-chip a first error amplifier and a second error amplifier. A non-inverting input 113 of the first error amplifier and a non-inverting input 114 of the second error amplifier are each coupled to ground. An inverting input 115 of the first error amplifier and an inverting input 116 of the second error amplifier are coupled to a reference terminal 117 of an on-chip reference regulator.

The PWM control circuit 106 has an on-chip output transistor accessible by a collector terminal 118 and an emitter terminal 119. The collector terminal 118 is coupled to the supply line VCC. The emitter terminal 119 is coupled to an input of the optocoupler 52 by way of a resistor 120.

In the above configuration, the PWM control circuit 106 generates, at the emitter terminal 119, a pulsed signal having a pulse width that is modulated in dependence upon the voltage at the DTC input 104.

The optocoupler 52 has an emitter output coupled to ballast ground, and a collector output coupled to the supply line VCC by way of the series combination of zener diode 76 and resistor 80. Both the collector output of the optocoupler 52 and the collector of the transistor 74 are coupled to an input of the filter 46.

The filter 46 comprises a resistor 140 and a capacitor 142 which form a low-pass filter. The filter 46 outputs a signal having a DC level based on the pulse width of either the signal generated by the firing-angle-to-PWM converter 44 or the signal generated by the voltage-to-PWM converter 50.

Preferred part numbers and component values are shown in TABLE I. It is noted, however, that alternative embodiments having alternative part numbers and/or alternative component values are also within the scope of the present invention.

TABLE I

| Component | Part Number/Component Value |
|---|---|
| Optocoupler 52 | 5IL00401 |
| Microcontroller 60 | PIC12C508 |
| Resistor 64 | 200 kOhms |
| Zener diode 70 | 4.7 V |
| Transistor 74 | 2N3904 |
| Resistor 75 | 2.3 kOhms |
| Zener diode 76 | 3.3 V |
| Resistor 80 | 10 kOhms |
| Capacitor 82 | 6800 pF, 600 V |
| Diode 84 | RGP10J |
| Transistor 86 | 2N3904 |
| Resistor 90 | 10 kOhms |
| Resistor 92 | 10 kOhms |
| Zener diode 94 | 48L01162S20, 15 V |
| Transistor 96 | 48L001186, 600 V, 1A |
| Resistor 100 | 6.8 kOhms |
| Resistor 102 | 3.6 kOhms |
| PWM control circuit 106 | TL494 |
| Resistor 110 | 10 kOhms |
| Capacitor 112 | 0.12 $\mu$F |
| Resistor 120 | 3.6 kOhms |
| Resistor 140 | 10 kOhms |
| Capacitor 142 | 10 $\mu$F |

Figure 3:
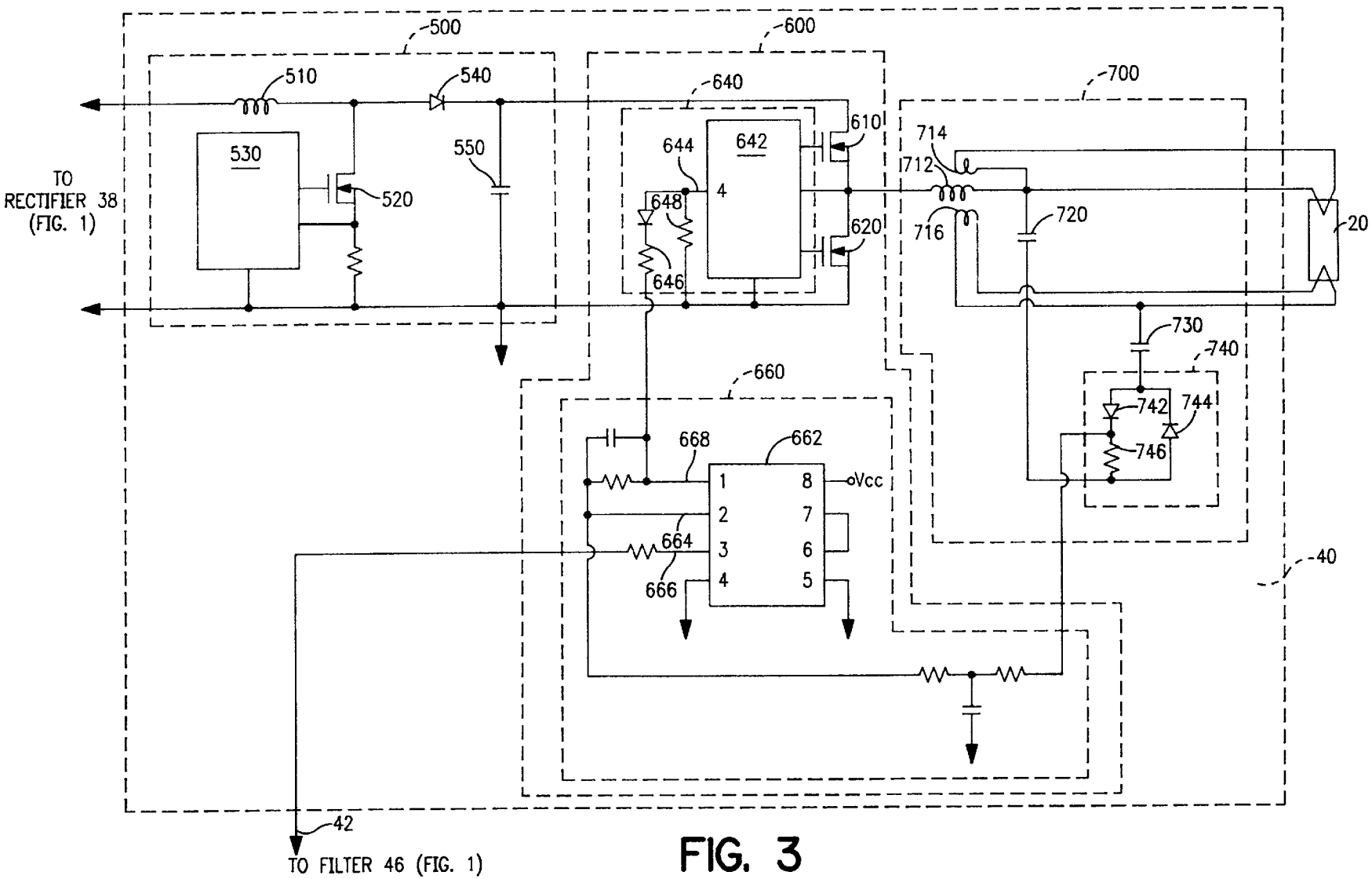
FIG. 3 is a schematic diagram of a preferred implementation of the PFC/inverter in the arrangement of FIG. 1.

As described in FIG. 3, the PFC/inverter circuit 40 may be implemented as a boost converter 500 combined with a half-bridge type inverter 600 and a series resonant output circuit 700.

Boost converter 500 comprises an inductor 510, a transistor 520, a boost control circuit 530, a rectifier 540, and an energy storage capacitor 550. Boost converter 500 accepts the full-wave rectified (but substantially unfiltered) voltage at the output of rectifier 38 (FIG. 1) and provides a filtered, substantially DC output voltage across capacitor 550. The DC voltage across capacitor 550 has a value that is greater than the peak of the full-wave rectified voltage at the output of rectifier 38. Additionally, when properly designed and controlled, boost converter 500 provides a high degree of power factor correction, so that the current drawn from the AC mains is substantially in-phase with the AC mains voltage. Boost converter 500 also ensures that the current drawn from the AC mains has substantially the same waveshape as the AC mains voltage.

Inverter 600 comprises a first transistor 610, a second transistor 620, a driver circuit 640, and a comparator circuit 660. Driver circuit 640 turns transistors 610,620 on and off in a substantially complementary fashion, such that when transistor 610 is on, transistor 620 is off, and vice versa. The frequency at which driver circuit 640 commutates transistors 610,620 may be varied in response to the external dimming inputs, thereby providing an adjustable illumination level for the lamp.

Resonant output circuit 700 comprises a transformer, a first capacitor 720, a second capacitor 730, and a lamp current sensing circuit 740. The transformer has a primary winding 712 that functions as an inductor. Primary winding 712 and first capacitor 720 function together as a series-resonant circuit that provides the dual functions of: (i) supplying a high voltage for igniting the lamp; and (ii) limiting the current supplied to the lamp after the lamp ignites. Secondary windings 714,716 provide power for heating the cathodes of the lamp. Second capacitor 730 serves as a DC blocking capacitor that ensures that the current provided to the lamp is substantially AC (i.e., has little or no DC component). Lamp current sensing circuit 740 comprises diodes 742,744 and a resistor 746. The voltage that develops across resistor 746 is proportional to the value of the lamp current. Diodes 742,744 serve to "steer" the positive half-cycles of the lamp current through resistor 746, while allowing the negative half-cycles of the lamp current to bypass resistor 746. As only the positive half-cycles of the lamp current need flow through resistor 746 in order to allow monitoring of the lamp current, the steering function of diodes 742,744 thus prevents unnecessary additional power dissipation in resistor 746.

Driver circuit 640 comprises a driver integrated circuit (IC) 642 having a frequency control input 644. Driver IC 642 may be realized, for example, using industry part number IR2155. Driver IC 642 provides complementary switching of the inverter transistors at a frequency that is determined by the effective resistance present between input 644 and ballast ground. The effective resistance present between input 644 and ballast ground is dependent upon the values of resistors 646,648 and the signal provided at the output 668 of comparator circuit 660.

Comparator circuit 660 comprises an operational amplifier IC 662 having inputs 664,666 and an output 668. Operational amplifier IC 662 may be realized, for example, by industry part number LM2904. In FIG. 3, pins 1, 2, and 3 of IC 662 correspond to the inputs and the output of an operational amplifier (op-amp) that is internal to the IC; more specifically, pin 1 is internally connected to the output of the op-amp, pin 2 is connected to the inverting (–) input of the op-amp, and pin 3 is connected to the non-inverting (+) input of the op-amp.

Comparator circuit 660 compares two signals: (i) the lamp current feedback signal from lamp current sensing circuit 740; and (ii) the dim level command signal provided at the output 42 of filter 46 (in FIG. 1). Comparator circuit 660 provides an appropriate output at pin 1 in response to any difference between the two quantities. The output at pin 1, in turn, controls the effective resistance present between input 644 of inverter driver IC 642 and ballast ground, which, in turn, determines the frequency at which driver IC 642 commutates the inverter transistors.

The detailed operation of circuitry substantially similar to driver circuit 640 and comparator circuit 660 is explained in greater detail in U.S. Pat. No. 5,457,360, the disclosure of which is incorporated herein by reference.

Figure 4:
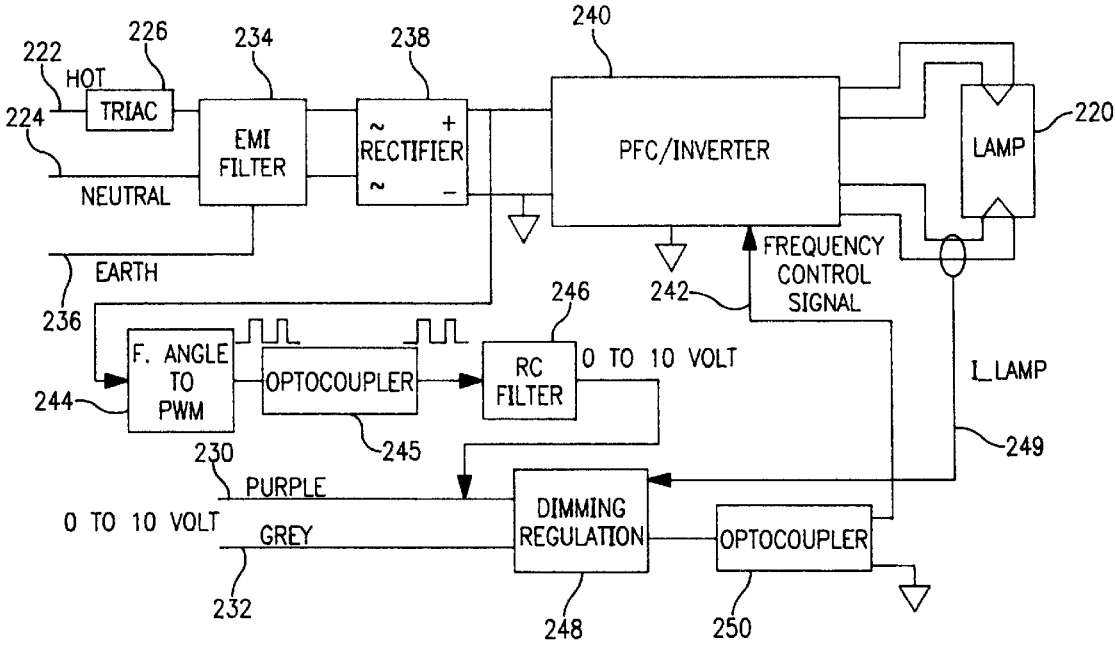
FIG. 4 is a block diagram of an alternative embodiment of a dual control dimming ballast apparatus for controlling a lamp.

FIG. 4 is a block diagram of an alternative embodiment of a dual control dimming ballast apparatus for controlling a lamp 220. The apparatus receives mains power from AC power lines 222 and 224. The AC power lines 222 and 224 may be referred to as either "HOT" and "NEUTRAL" respectively, or "SUPPLY" and "COMMON" respectively.

A phase-cut triac 226 may be coupled to the AC power line 222 to provide a power-line-type control for dimming the lamp 220. The phase-cut triac 226 varies a firing angle of a phase-cut powering signal to encode a dimming-control signal therein. The dual control dimming ballast apparatus is capable of dimming the lamp 220 based on the firing angle.

A non-power-line dimming control signal is receivable via inputs 230 and 232. Preferably, the non-power-line dimming control signal comprises a DC voltage applied across the inputs 230 and 232. The DC voltage is variable within a range such as 0 VDC to 10 VDC. Preferably, the DC voltage has an amplitude less than that of the AC powering signal. The dual control dimming ballast apparatus is further capable of dimming the lamp 220 based on the DC voltage.

An EMI filter 234 is coupled to an output of the triac 226, the AC power line 224 and an earth ground line 236. The EMI filter 234 provides an AC signal to a rectifier 238 coupled thereto. The rectifier 238 rectifies the filtered AC signal for application to a PFC/inverter circuit 240 coupled thereto. The PFC/inverter circuit 240 is for controlling and powering the lamp 220 based upon power received from rectifier 238 and a frequency control signal received from an input 242.

A firing-angle-to-PWM converter 244 is coupled to the output of the rectifier 238. The firing-angle-to-PWM converter 244 generates a pulsed signal whose pulse width is modulated based on the firing angle of the output of rectifier 238.

An optocoupler 245 couples the firing-angle-to-PWM converter 244 to a filter 246, such as a low pass filter. The filter 246 produces a signal having a DC voltage level related to the pulse width from the firing-angle-to-PWM converter 244. The signal from the filter 246 is applied to the input 230. The optocoupler 245 optically isolates the firing-angle-to-PWM converter 244 and the other ballast circuitry from the inputs 230 and 232.

A dimming regulation circuit 248 is responsive to the inputs 230 and 232, to the output of the filter 246, and to a sensed lamp current signal from line 249. The dimming regulation circuit 248 produces a frequency control signal based upon a sensed lamp current and a DC voltage signal applied to the inputs 230 and 232. The dimming regulation circuit 248 is coupled to the input 242 by an optocoupler 250. The PFC/inverter circuit 240 dims the lamp 220 based on the frequency control signal received from optocoupler 250.

The firing-angle-to-PwM converter 244, the optocoupler 245, the filter 246, the dimming regulation circuit 248, the optocoupler 250 and the PFC/inverter circuit 240 cooperate to dim the lamp 220 based on the firing angle produced by the phase-cut triac 226. The dimming regulation circuit 248, the optocoupler 250 and the PFC/inverter circuit 240 cooperate to dim the lamp 220 based on the voltage between the inputs 230 and 232.

Figure 5:
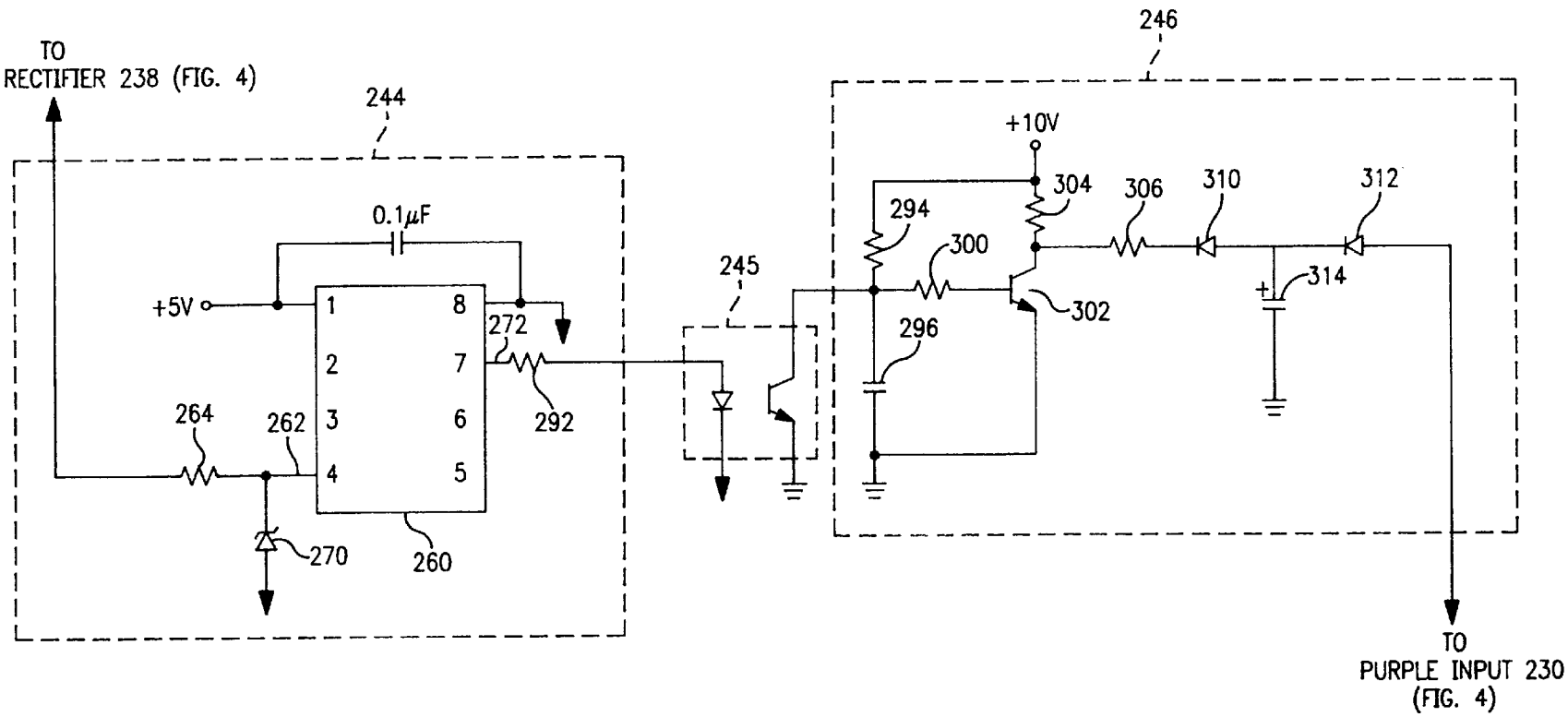
FIG. 5 is a schematic diagram of a preferred implementation of the firing-angle-to-PWM converter, the optocoupler, and the filter in the arrangement of FIG. 4.

FIG. 5 is a schematic diagram of an implementation of the firing-angle-to-PWM converter 244, the optocoupler 245 and the filter 246 of FIG. 4. The firing-angle-to-PWM converter 244 comprises a microcontroller 260. The microcontroller 260 has an input 262 coupled to the rectifier 238 of FIG. 4 by way of a resistor 264. The input 262 is coupled to ground through a zener diode 270. The microcontroller 260 is programmed to convert a firing angle received at the input 262 to a pulse width modulated signal provided at an output 272. The output 272 is coupled to the optocoupler 245 by way of a resistor 292.

The optocoupler 245 has an emitter output coupled to ballast ground, and a collector output coupled to a 10 Volt supply line through resistor 294. A capacitor 296 couples the collector output of the optocoupler 245 to ballast ground. A resistor 300 couples the collector output of the optocoupler 245 to a base of a transistor 302. An emitter of the transistor 302 is connected to ballast ground. A collector of the transistor 302 is coupled to the 10 Volt supply line by a resistor 304.

The collector of the transistor 302 is coupled to the input 230 by a series combination of a resistor 306 and diodes 310 and 312. The junction of diodes 310 and 312 is coupled to ballast ground by a capacitor 314.

Figure 6:
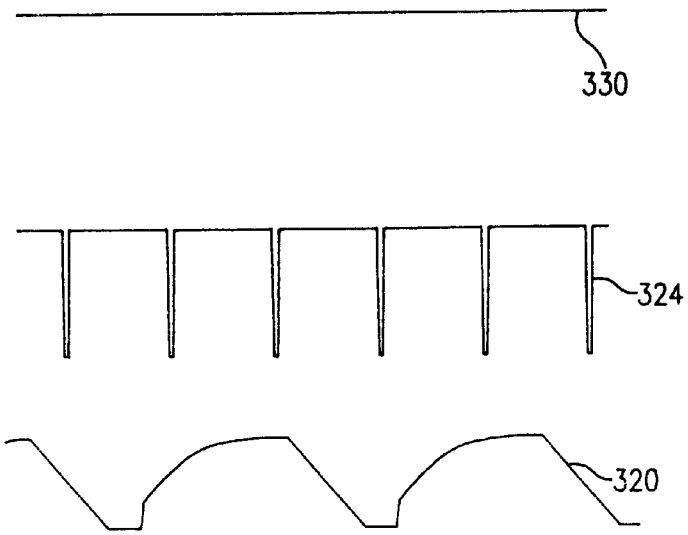
FIG. 6 shows example waveforms for an approximately full conduction condition in the implementation of FIG. 5.
Figure 7:
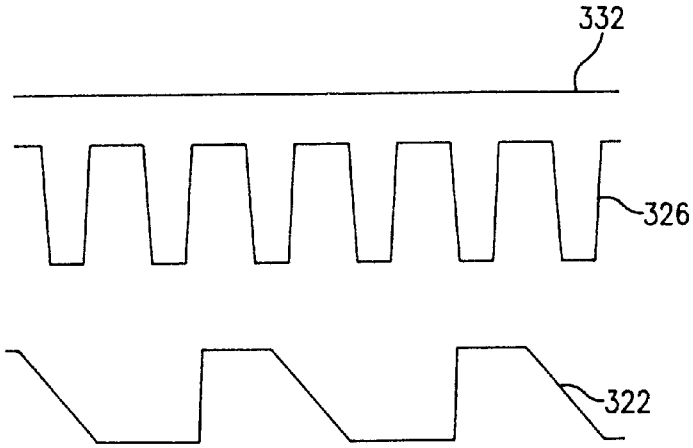
FIG. 7 shows example waveforms for an approximately 90° conduction condition in the implementation of FIG. 5.

The above-described implementation of the firing-angle-to-PWM converter 244 generates, at the output 272, a PWM signal whose duty cycle varies in response to a rectified phase-cut voltage from the rectifier 38. FIGS. 6 and 7 show examples of the rectified voltage when a phase-cut dimmer is used in series with the ballast. FIG. 6 shows a rectified voltage waveform 320 for an approximately full conduction condition. In this condition, the lamp current is about 180 milliamperes. FIG. 7 shows a rectified voltage waveform 322 for an approximately 90° conduction condition. In this condition, the lamp current is about 80 milliamperes.

FIG. 6 further illustrates a pulsed waveform 324 generated at the output 272 based on the rectified voltage waveform 320. FIG. 7 further illustrates a pulsed waveform 326 generated at the output 272 based on the rectified voltage waveform 322. The optocoupler 245 and the circuitry including transistor 302 cooperate to isolate and regenerate the waveform generated at the output 272. The regenerated waveform present at the collector of the transistor 302 has an amplitude of about 10 Volts. The voltage across the capacitor 314 has a DC level based on the pulse width of the regenerated waveform. The DC level varies from about 10 VDC (waveform 330 in FIG. 6) to about 1 VDC (waveform 332 in FIG. 7) to thereby dim the light output of a 0 to 10 VDC controlled dimming ballast.

Preferred part numbers and component values are shown in TABLE II. It is noted, however, that alternative embodiments having alternative part numbers and/or alternative component values are also within the scope of the present invention.

TABLE II

| Component | Part Number/Component Value |
|---|---|
| Microcontroller 260 | PIC12C509 |
| Resistor 264 | 200 kOhms |
| zener diode 270 | 4.7 V |
| Capacitor 288 | 0.1 $\mu$F |
| Resistor 292 | 5 kOhms |
| Resistor 294 | 20 kOhms |
| Capacitor 296 | 1000 pF |
| Resistor 300 | 200 kOhms |
| Resistor 304 | 10 kOhms |
| Resistor 306 | 200 Ohms |
| Diode 310 | 1N4148 |
| Diode 312 | 1N4148 |
| Capacitor 314 | 22 $\mu$F |

Thus, there have been described herein several embodiments including a preferred embodiment of a dual control dimming ballast.

It will be apparent to those skilled in the art that the disclosed invention may be modified in numerous ways and may assume many embodiments other than the preferred form specifically set out and described above. For example, in alternative embodiments, some pairs of components may be indirectly coupled rather than being directly coupled as in the preferred form. Therefore, the term "coupled " as used herein is inclusive of both directly coupled and indirectly coupled. By indirectly coupled, it is meant that a pair of components are coupled by one or more intermediate components. Further, alternative phase-control dimmers may be substituted for the herein-disclosed phase-cut triacs.

Accordingly, it is intended by the appended claims to cover all modifications of the invention which fall within the true spirit and scope of the invention.

What is claimed is:

1. A dimming ballast apparatus comprising:

a first DC input;

a second DC input;

a first capacitor which couples the first DC input to the second DC input;

a first transistor having a base, a collector and an emitter, the collector coupled to a supply line;

a series combination of a first resistor and a second resistor which couples the base of the first transistor to the supply line;

a diode having a cathode coupled to the first DC input and an anode coupled to the base of the first transistor;

a first zener diode coupling a junction of the first resistor and the second resistor to a control ground;

a second transistor having a gate coupled to the junction of the first resistor and the second resistor, a drain coupled to the second input, and a source coupled to control ground;

a series combination of a third resistor and a fourth resistor which couples the emitter of the first transistor to control ground;

a pulse width modulation circuit having an input and an output, the input coupled to a junction of the third resistor and the fourth resistor;

an optocoupler having an input coupled to the output of the pulse width modulation circuit, an emitter output coupled to a ballast ground, and a collector output;

a series combination of a second zener diode and a fifth resistor which couples the collector output of the optocoupler to a supply line;

a rectifier coupleable to a power line;

a firing-angle-to-pulse-width-modulation converter coupled to the rectifier;

a third transistor having a base coupled to an output of the firing-angle-to-pulse-width-modulation converter, a collector coupled to the collector output of the optocoupler, and an emitter coupled to ballast ground;

a low-pass filter coupled to the collector output of the optocoupler; and an inverter circuit coupled to the rectifier, the inverter circuit having a dim level command input responsive to the low-pass filter.

2. A dimming ballast apparatus comprising:

a dimming regulation circuit having a first DC input and a second DC input;

a rectifier coupleable to a power line;

a firing-angle-to-pulse-width-modulation converter coupled to the rectifier;

an optocoupler having an input coupled to the firing-angle-to-pulse-width-modulation converter, an emitter output coupled to a control ground, and a collector output;

a first resistor which couples the collector output of the optocoupler to a supply line;

a first capacitor which couples the collector output of the optocoupler to control ground;

a transistor having a base, a collector, and an emitter, the emitter coupled to control ground;

a second resistor which couples the collector output of the optocoupler to the base of the transistor;

a third resistor which couples the collector of the transistor to the supply line;

a series combination of a fourth resistor, a first diode and a second diode, which couples the collector of the transistor to the first input of the dimming regulation circuit;

a second capacitor which couples the junction of the first diode and the second diode to control ground;

an inverter circuit coupled to the rectifier, the dimmable inverter circuit having a dim level command input; and an optocoupler which couples the dimming regulation circuit to the dim level command input of the inverter circuit.

3. A dimming ballast apparatus, comprising:

at least one power line dimming control input;

at least one non-power-line dimming control input;

a firing-angle--to- pulse-width-modulation converter responsive to t hie power line dimming control input;

a voltage-to-pulse-width-modulation converter responsive to the non-power--line chiming control input;

a low-pass filter responsive to the firing-angle-to-pulse-width-modulation converter and the voltage-to-pulse-width-modulation converter;

a dimming ballast circuit having a dim level command input responsive to the low-pass filter; and wherein the at least one non-power-line dimming control input comprises a first input and a second input, and wherein the voltage-to-pulse-width-modulation converter comprises:

a capacitor which couples the first input to the second input;

a first transistor having a base, a collector and an emitter, the collector coupled to a supply line;

a series combination of a first resistor and a second resistor which couples the base of the first transistor to the supply line;

a diode having a cathode coupled to the first input and an anode coupled to the base of the first transistor;

a zener diode coup ling a junction of the first resistor and the second resistor to a control ground;

a second transistor having a gate coupled to the junction of the first resistor and the second resistor, a drain coupled to the second input, and a source coupled to control ground;

a series combination of a third resistor and a fourth resistor which couples the emitter of the first transistor to control ground; and a pulse width modulation circuit having an input coupled to a junction of -he third resistor and the fourth resistor.

4. A dimming ballast apparatus, comprising:

at least one power line dimming control input;

at least one non-power-line dimming control input;

a firing-angle-to-pulse-width-modulation converter responsive to the power line dimming control input;

an optocoupler having an input coupled to the firing-angle-to-pulse-width-modulation converter, an emitter output coupled to a control ground, and a collector output;

a first resistor which couples the collector output of the optocoupler to a supply line;

a first capacitor which couples the collector output of the optocoupler to control ground;

a transistor having a base, a collector, and an emitter, the emitter coupled to control ground;

a second resistor which couples the collector output of the optocoupler to the base of the transistor;

a third resistor which couples the collector of the transistor to the supply line;

a series combination of a fourth resistor, a first diode and a second diode, which couples the collector of the transistor to the non-power-line dimming control input; and a second capacitor which couples the junction of the first diode and the second diode to control ground.

5. A dimming ballast apparatus, comprising:

at least one power line dimming control input;

at least one non-power-line dimming control input;

a firing-angle-to-pulse-width-modulation converter responsive to the power line dimming control input;

a low-pass filter responsive to the firing-angle-to-pulse-width-modulation converter;

a dimming regulation circuit responsive to the low-pass filter and the non-power-line dimming control input;

an inverter circuit having a dim level command input responsive to the dimming regulation circuit; and an optocoupler which couples the fir ing-angle-to-pulse-width-modulation converter to the low--pass filter.

6. A dimming ballast apparatus, comprising:

at least one power line dimming control input;

at least one non-power-line dimming control input;

a firing-angle-to-pulse-width-modulation converter responsive to the power line dimming control input;

a low-pass filter responsive to the firing-angle-to-pulse-width-modulation converter;

a dimming regulation circuit responsive to the low-pass filter and the non-power-line dimming control input;

an inverter circuit having a dim level command input responsive to the dimming regulation circuit; and an optocoupler which couples the dimming regulation circuit to the dim level command input of the inverter circuit.

7. A dimming ballast apparatus, comprising:

at least one power line dimming control input;

at least one non-power-line dimming control input;

a firing-angle-to-pulse-width-modulation converter responsive to the power line dimming control input;

a voltage-to-pulse-width-modulation converter responsive to the non-power-line dimming control input;

a low-pass filter responsive to the firing-angle-to-pulse-width-modulation converter and the voltage-to-pulse-width-modulation converter;

a dimming ballast circuit having a dim level command input responsive to the low-pass filter; and an optocoupler which couples the voltage-to-pulse-width-modulation converter to the low-pass filter.

8. The dimming ballast apparatus of claim 7 wherein the optocoupler has an input coupled to the voltage-to-pulse-width-modulation converter, an emitter output coupled to a ballast ground, and a collector output coupled to the low-pass filter, the dimming ballast apparatus further comprising:

a series combination of a zener diode and a resistor which couples the collector output of the optocoupler to a supply line; and a transistor having a base coupled to an output of the firing-angle-to-pulse-width-modulation converter, a collector coupled to the collector output of the optocoupler, and an emitter coupled to ballast ground.

* * * * *